US007694541B2

(12) United States Patent
Shum

(10) Patent No.: US 7,694,541 B2
(45) Date of Patent: Apr. 13, 2010

(54) PADLOCK HAVING A PRELOADED LOCKING MEMBER

(75) Inventor: Jimmy Shum, Cha Kwo Ling (HK)

(73) Assignee: ABUS August Bremicker Soehne KG, Wetter-Volmarstein (DE)

( * ) Notice: Subject to any disclaimer, the term of this patent is extended or adjusted under 35 U.S.C. 154(b) by 0 days.

(21) Appl. No.: 12/115,695

(22) Filed: May 6, 2008

(65) Prior Publication Data

US 2009/0277230 A1 Nov. 12, 2009

(51) Int. Cl.
*E05B 37/06* (2006.01)

(52) U.S. Cl. ..... 70/25; 70/26; 70/38 B; 70/52; 70/53; 70/333 R

(58) Field of Classification Search ..... 70/24–26, 70/38 B, 51–56, 333 R, 416–418
See application file for complete search history.

(56) References Cited

U.S. PATENT DOCUMENTS

| | | | | | |
|---|---|---|---|---|---|
| 940,763 | A * | 11/1909 | Whalen | 70/28 |
| 1,486,037 | A * | 3/1924 | Rousseau | 70/437 |
| 1,622,999 | A * | 3/1927 | Frith | 70/38 A |
| 1,955,809 | A * | 4/1934 | Hobbs | 109/23 |
| 2,047,969 | A * | 7/1936 | Keil | 70/52 |
| 2,127,089 | A * | 8/1938 | Schamp et al. | 70/25 |
| 2,824,439 | A * | 2/1958 | Soref et al. | 70/38 B |
| 3,194,033 | A * | 7/1965 | Markert et al. | 70/38 B |
| 3,653,235 | A * | 4/1972 | Fane et al. | 70/38 A |
| 4,444,029 | A * | 4/1984 | Remington | 70/25 |
| 4,733,548 | A * | 3/1988 | Ling | 70/25 |
| 5,005,384 | A * | 4/1991 | Lo et al. | 70/25 |
| 5,520,032 | A * | 5/1996 | Ling | 70/25 |
| 5,715,709 | A * | 2/1998 | Lai | 70/25 |
| 5,839,301 | A * | 11/1998 | Hsu | 70/25 |
| 7,340,927 | B2 * | 3/2008 | Yu et al. | 70/21 |
| 7,363,782 | B1 * | 4/2008 | Misner et al. | 70/21 |
| 7,458,240 | B1 * | 12/2008 | Miao | 70/21 |
| 2004/0093914 | A1 * | 5/2004 | Vito | 70/38 A |

OTHER PUBLICATIONS

ABUS combination padlock No. 165/40, photograph #1.
ABUS combination padlock No. 165/40, photograph #2.
ABUS combination padlock No. 165/40, photograph #3.

* cited by examiner

*Primary Examiner*—Lloyd A Gall
(74) *Attorney, Agent, or Firm*—Gifford, Krass, Sprinkle, Anderson & Citkowski, P.C.

(57) ABSTRACT

A padlock comprises a lock body including at least one passage defined therein. A shackle is displaceable between open and secured positions. The shackle has at least one leg which is slideable within the at least one passage and which includes a notch. A locking member is accommodated within the lock body and is displaceable between unlocked and locked positions. The locking member is preloaded towards the locked position to engage the notch to inhibit movement of the shackle from the secured position into the open position. One of the at least one passage and the at least one leg defines at least one recess. The other one of the at least one passage and the at least one leg defines at least one projection that extends into the at least one recess.

10 Claims, 2 Drawing Sheets

PADLOCK HAVING A PRELOADED LOCKING MEMBER

FIELD

The present disclosure relates to padlocks.

BACKGROUND

The statements in this section merely provide background information related to the present disclosure and may not constitute prior art.

One type of padlock is a combination padlock. This type of padlock includes advantages over other types of padlocks, a padlock having a key locking mechanism, for example, because combination padlocks do not require carrying around a key. Instead, a memorized combination is used to unlock the padlock.

Padlocks typically include a lock body and a lockable shackle that is used to secure the padlock to a structure. Common structures include, but are not limited to, sheds, trunks, lockers and lock boxes.

A particular kind of padlocks is a padlock having a movable locking member that is used to lock the shackle in a secured position by engaging a notch defined in the shackle, wherein the locking member is preloaded towards the locked position. Pressing down the shackle into the lock body pushes back the preloaded locking member momentarily until it springs forward again to snap into and engage the notch. This procedure allows easy and fast securement of the padlock to a structure.

Such padlocks, however, may be susceptible to direct mechanical attacks, such as the use of a padlock shim which in some cases may release the shackle without using a key or entering a combination by the authorized user.

One object of this disclosure is to provide a novel and improved padlock which is less susceptible to mechanical attacks.

SUMMARY

Accordingly, the present disclosure provides a padlock that comprises a lock body including at least one passage defined therein. A shackle is displaceable between open and secured positions. The shackle has at least one leg. The at least one leg is slideable within the at least one passage and includes a notch. A locking member is accommodated within the lock body and is displaceable between unlocked and locked positions. The locking member is preloaded towards the locked position to engage the notch to inhibit movement of the shackle from the secured position into the open position. One of the at least one passage and the at least one leg defines at least one recess. The other one of the at least one passage and the at least one leg defines at least one projection that extends into the at least one recess when said shackle is in said secured position.

In another feature, the at least one recess and at least one projection are arranged at that circumferential side of the at least one passage and said at least one leg where the locking member selectively engages the notch.

In still another feature, the at least one passage and the at least one leg define a plurality of recesses, wherein the at least one passage and the at least one leg define a corresponding plurality of projections that engage a respective one of the recesses, and wherein the recesses and projections are arranged along the periphery of the at least one leg and the at least one passage, respectively.

In another feature, the at least one leg defines the at least one recess, wherein the at least one recess extends throughout that portion of the at least one leg that is disposed within the at least one passage in the secured position.

In yet another feature, the at least one passage defines the at least one projection and an aperture in the lock body, wherein the at least one projection is arranged at least at the aperture.

In another feature, the lock body has an outer casing, wherein the at least on projection is integrally formed with the outer casing.

The padlock of the present disclosure impedes that the preloaded locking member can be pushed back by a padlock shim or the like when the shackle is in the secured position and the locking member is in the locked position. Customarily, a padlock shim comprises a cylindrical wall portion made of sheet metal to be inserted into a typically ring-shaped gap between the boundary of the at least one passage and the at least one leg near the region where the locking member selectively engages the notch. If the cylindrical wall of such a padlock shim reaches down to the locking member in some cases the locking member can be pushed back to release the shackle by rotating the cylindrical wall around its cylinder axis towards the locking member. By providing the at least one recess and the at least one projection that cooperates with the at least one recess said ring-shaped gap gets blocked which in turn bars the padlock shim from revolving around its cylinder axis.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
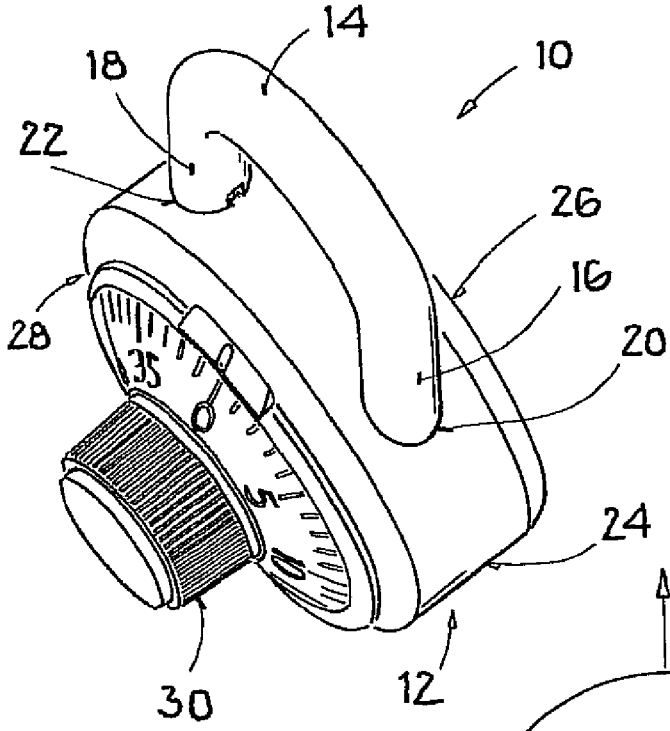
FIG. 1 is a perspective view of a padlock in accordance with the present disclosure according to a first embodiment.

The following description is merely exemplary in nature and is not intended to limit the present disclosure, application, or uses. It should be understood that throughout the drawings, corresponding reference numerals indicate like or corresponding parts and features.

Referring now to FIG. 1, a rotary combination padlock 10 is illustrated and includes a lock body 12 and a U-shaped shackle 14 having first and second legs 16, 18 that are slideably received in a respective one of first and second passages 20, 22 defined in the lock body 12. The lock body 12 has an outer casing including a cylindrical side wall 24, a back plate 26 as well as a front plate 28. The front plate 28 carries an external single-dial rotary knob 30 including numbers.

Figure 2:
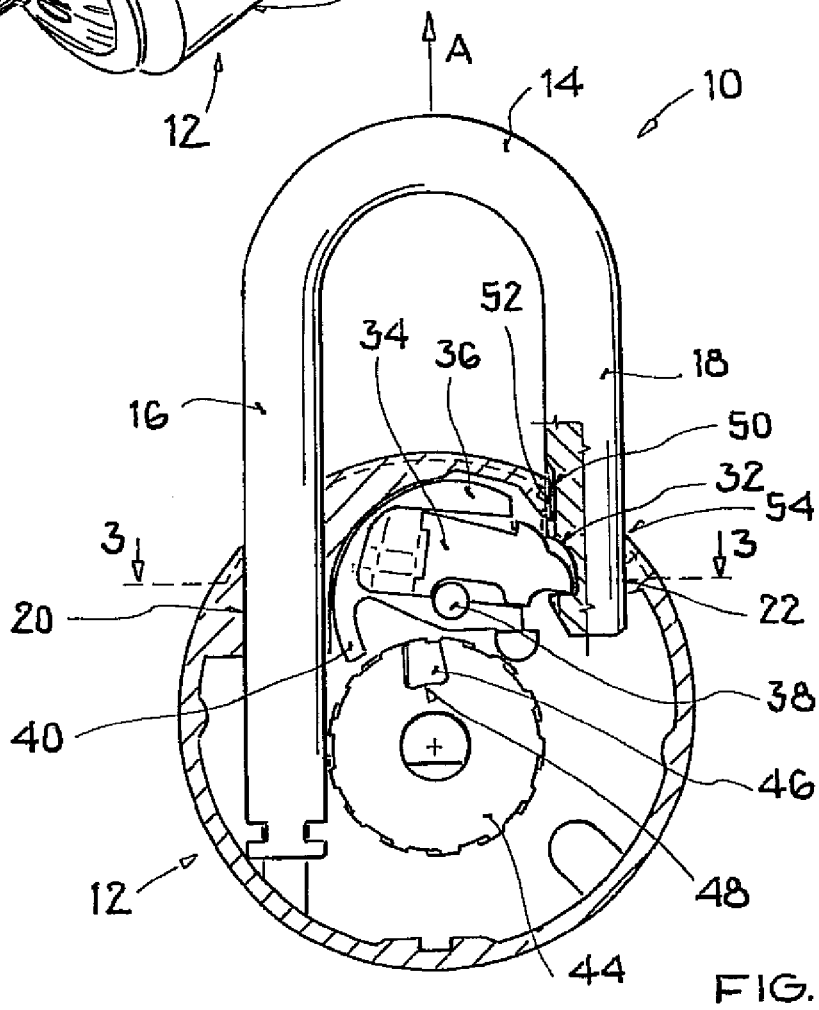
FIG. 2 is a cross-sectional back view through the center of the padlock of FIG. 1.

Referring now to FIG. 2, the second leg 18 includes a notch 32 which is selectively engaged by a locking member 34 accommodated within the lock body 12 to inhibit displacement of the shackle 14 in the direction A. The locking member 34 is displaceable between a locked position, which is shown in FIG. 2, and an unlocked position, in which the locking member 34 is retracted from the notch 32 thereby releasing the shackle 14. The locking member 34 is preloaded towards the locked position by a spring member (not shown). A locking member mounting 36 is pivotally mounted to a post 38 and is adapted to slidingly accommodate therein the locking member 34. The locking member mounting 36 is provided with a curved downwardly extending protrusion 40.

To retract the locking member 34 from the notch 32 and thus to release the shackle 14, a combination (i.e. sequence of numbers) must be entered by using the single-dial rotary knob 30 to manipulate the rotational positions of a plurality of (usually three) parallel discs or cams accommodated within the lock body 12. In FIG. 2 two discs 44, 46 are visible. Each of the discs 44, 46 has an indentation 48, wherein the indentations 48 of the plurality of discs 44, 46 align when the correct combination is entered, thus allowing the protrusion 40 to fit into the indentations 48. This in turns allows the locking member mounting 36 to rotate counterclockwise thereby retracting the locking member 34 from the notch 32.

To enable actuation of the discs the single-dial rotary knob 30 includes an off-center positioned catch (not shown) on its back side and each of the discs includes an off-center positioned catch (not shown) on each of its sides, wherein the catches facing each other may engage. As the single-dial rotary knob 30 rotates in a first direction, its catch connects to the front side catch of the first disc, thus causing the first disc to rotate with the single-dial rotary knob 30. As the first disc rotates, its back side catch connects to the front side catch of the second disc, thus causing the second disc to rotate with the single-dial rotary knob 30 and the first disc. This is continued until the last disc rotates with the single-dial rotary knob 30 and all other discs. The rotation is stopped when the last disc is in the correct position to allow protrusion 40 to fit into the last disc's indentation 48. Then the single-dial rotary knob 30 is rotated in the opposite direction to connect to all discs but the last one from the other side. The rotation is stopped when the last but one disc is in the correct position to allow protrusion 40 to fit into the last but one disc's indentation 48. This procedure is repeated until all discs are in the correct position. The shackle 14 may now be pulled back from its secured position (shown in FIG. 2) into an open position.

Starting from this open position the shackle 14 may at any time be pushed back into the lock body to resume its secured position. This may be done independently of the rotational position of the rotary knob 30 and the discs 44, 46, since the locking member 34 is spring-loaded into its locked position (so-called automatic locking function).

The above described mechanism for retracting a locking member from a notch defined in a leg of a shackle is well known to the skilled practitioner and is described in U.S. Pat. No. 3,194,033, for example, the disclosure of which is incorporated herein by reference in its entirety.

As explained above, the shackle 14 is displaceable between a secured position, which is shown in FIG. 2, and an open position, in which the second leg 18 is fully withdrawn from the second passage 22. The first leg 16 is longer than the second leg 18 and can not be fully withdrawn from the first passage 20. In the open position, the shackle 14 is displaced along direction A with respect to its secured position.

The second leg 18 defines a groove 50 which extends axially with respect to the second leg 18. The groove 50 is formed on the inner side of the second leg 18, i.e. on that circumferential section of the second leg 18 which faces the first leg 16. The locking member 34 is positioned between the first and second legs 16, 18. The groove 50 is thus formed on that side of the second leg 18 where the locking member 34 selectively engages the notch 32. The groove 50 extends throughout that axial portion of the second leg 18 that is disposed within the second passage 22 in the secured position. In particular, the groove 50 extends below and above notch 32.

The second passage 22 defines a projection 52 that juts into the groove 50 of the second leg 18. The projection 52 is integrally formed with the cylindrical side wall 24 of the lock body 12 and extends downwardly from an aperture 54 defined by the second passage 22 in the lock body 12 to a certain point above notch 32.

Figure 3:
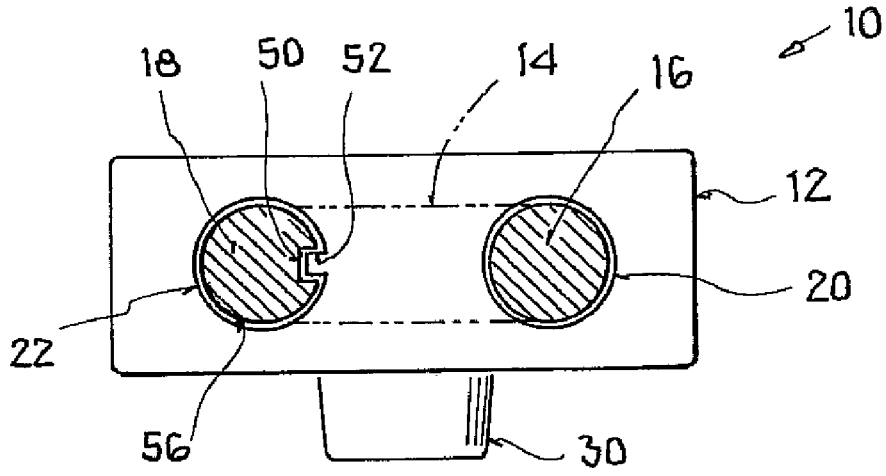
FIG. 3 is a cross-sectional view of the padlock along line 3-3 of FIG. 2.

Except for the groove 50 and the projection 52 each of the second leg 16 and the second passage 22 is circular in cross-section, as shown in FIG. 3, but in principle could be oval, square or exhibit any other shape just as well. The boundary of the second passage 22 and the second leg 18 define a substantially ring-shaped gap 56 thereinbetween which ring-shape is interrupted by the projection 52 that extends over the width of the gap 56 into the groove 50 (see FIG. 3). Each of the groove 50 and the projection 52 is substantially rectangular in cross-section.

Figure 5:
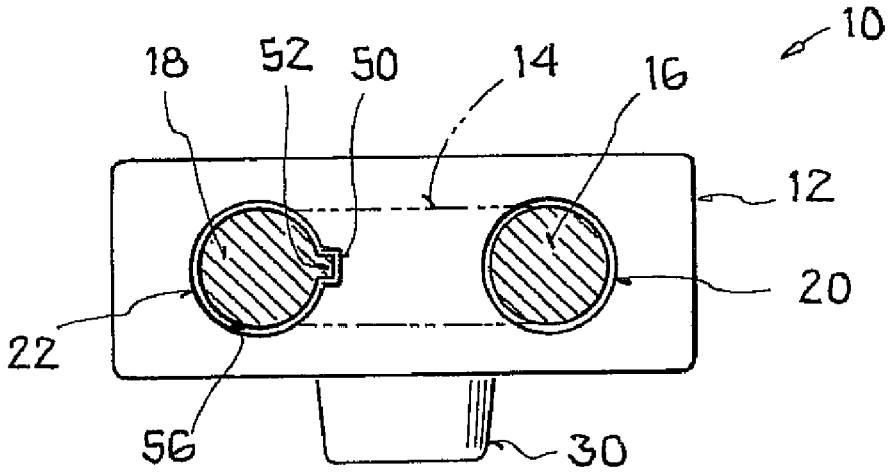
FIG. 5 is a cross-sectional view as in FIG. 3 of a padlock according to still another embodiment.

Alternatively, the second leg 18 may define the projection 52 and the second passage 22 may define the groove 50 (see FIG. 5)

Figure 4:
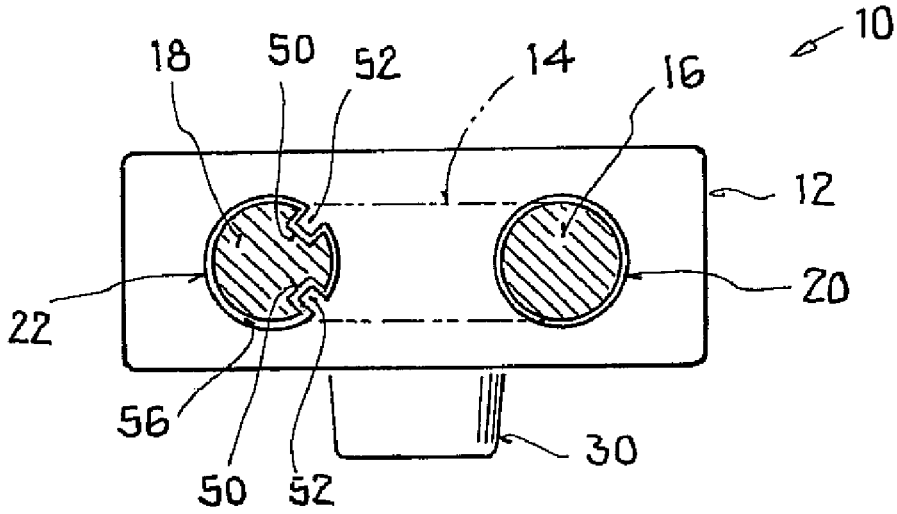
FIG. 4 is a cross-sectional view as in FIG. 3 of a padlock according to another embodiment.

As can be discerned from FIG. 4, the padlock 10 may as well be provided with a plurality of pairs of groove 50 and projection 52. In FIG. 4, the pairs are defined along the circumference of the second passage 22 and the second leg 18, respectively, to flank the circumferential region where the locking member 34 selectively engages the notch 32.

However, the padlock 10 may be provided with any other number of pairs of groove 50 and projection 52, and these pairs may be defined at any position along the periphery of the second passage 22 and the second leg 18. In addition, for one pair the groove 50 may be defined by the second leg 18 and the projection 52 may be defined by the second passage 22, whereas for another pair the groove 50 may be defined by the second passage 22 and the projection 52 may be defined by the second leg 18. Further, the cross-section of the groove 50 and the projection 52 may be triangular, trapezoidal or exhibit any other shape just as well.

By providing said at least one groove 50 and said at least one projection 52 which extends into the associated groove 50 the spring-loaded locking member 34 may not easily be pushed back into its unlocked position by means of a flat tool inserted into the gap 56 between the boundary of the second passage 22 and the second leg 18 when the shackle 14 is in its secured position. Therefore, a higher degree of security is obtained.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

What is claimed is:

1. A padlock, comprising:

a lock body including at least one passage defined therein;

a shackle displaceable between open and secured positions, said shackle having at least one elongated leg, said at least one leg being slideable within said at least one passage and including a notch, said at least one leg being completely removed from said lock body when said shackle is in said open position;

a locking member accommodated within said lock body and displaceable between unlocked and locked positions, said locking member being preloaded towards said locked position to engage said notch to inhibit movement of said shackle from said secured position into said open position wherein the locking member may be pushed back from its locked position into its unlocked position when the shackle is in its secured position independently of the position of a locking mechanism cooperating with the locking member;

wherein one of said at least one passage and said at least one leg defines at least one recess which extends in a transverse direction from its circumference relative to a longitudinal axis of said at least one leg;

wherein the other one of said at least one passage and said at least one leg defines at least one projection complementary in shape to said at least one recess that extends in the transverse direction from its circumference relative to said longitudinal axis of said at least one leg, at least a portion of said at least one projection being positioned in said at least one recess when said shackle is in said secured position; and wherein at least a portion of said recess and said projection are aligned with at least a portion of said notch as viewed along said longitudinal axis of said at least one leg when said shackle is in said secured position.

2. The padlock of claim 1 wherein said at least one recess and said at least one projection are arranged at a side of said at least one passage and said at least one leg which faces said locking member.

3. The padlock of claim 1 wherein said lock body has an outer casing, wherein said at least one projection or said at least one recess is formed at said outer casing.

4. The padlock of claim 1 wherein said at least one recess extends along an axis of said at least one passage or said at least one leg.

5. The padlock of claim 1 wherein one of said at least one passage and said at least one leg defines a plurality of recesses, wherein one of said at least one passage and said at least one leg defines a corresponding plurality of projections that extends into a respective one of said recesses, and wherein said recesses and projections are arranged along the periphery of said at least one leg and said at least one passage, respectively.

6. The padlock of claim 1 wherein said at least one leg defines said at least one recess, and wherein said at least one recess extends throughout an axial portion of said at least one leg that is disposed within said at least one passage when said shackle is in said secured position.

7. The padlock of claim 1 wherein said at least one passage defines said at least one projection and an aperture in said lock body, wherein said at least one projection is formed at said aperture.

8. The padlock of claim 1 wherein said locking member is preloaded by a spring member.

9. The padlock of claim 1 further comprising a rotatable actuation member for effecting displacement of said locking member from said locked position into said unlocked position.

10. The padlock of claim 1 wherein said padlock is a combination padlock.

* * * * *